US005863001A

United States Patent [19]

Schulze

[11] Patent Number: 5,863,001

[45] Date of Patent: Jan. 26, 1999

[54] CRUSHING METHOD AND APPARATUS

[75] Inventor: Herbert C. Schulze, Reno, Nev.

[73] Assignee: Dynachieve, Inc., Reno, Nev.

[21] Appl. No.: 814,055

[22] Filed: Mar. 10, 1997

[51] Int. Cl.[6] ..... B02C 19/08

[52] U.S. Cl. ..... 241/30; 241/169; 241/169.2; 241/DIG. 27

[58] Field of Search ..... 241/DIG. 27, DIG. 17, 241/169, 169.2, 264, 266, 30

[56] References Cited

U.S. PATENT DOCUMENTS

| | | | |
|---|---|---|---|
| 979,364 | 12/1910 | Baudement et al. | 241/169 |
| 1,930,056 | 10/1933 | Klingler | 241/169 |
| 2,631,786 | 3/1953 | Morgan et al. | 241/DIG. 27 |
| 3,915,393 | 10/1975 | Elkins | 241/DIG. 27 |
| 4,003,523 | 1/1977 | Doolittle | 241/DIG. 27 |
| 5,123,601 | 6/1992 | Lavin et al. | 241/DIG. 27 |
| 5,531,386 | 7/1996 | Jensen | 241/DIG. 27 |

FOREIGN PATENT DOCUMENTS

| | | | |
|---|---|---|---|
| WO 94/003091 | 2/1994 | WIPO | 241/169.2 |

OTHER PUBLICATIONS

Ocelco Announcement.

*Primary Examiner*—Mark Rosenbaum

[57] ABSTRACT

A method and apparatus for crushing various items such as medicinal pills, foods, including garlic, and the like, wherein a biased force is applied between an item in a pocket and a boss conforming to the interior configuration of the pocket resulting in a gradual crushing of the product.

6 Claims, 4 Drawing Sheets

FIG. 3
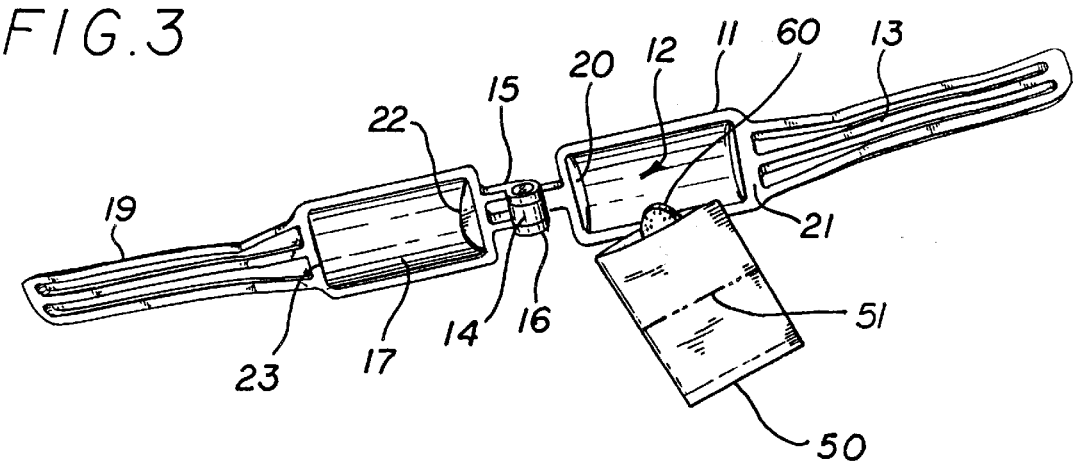
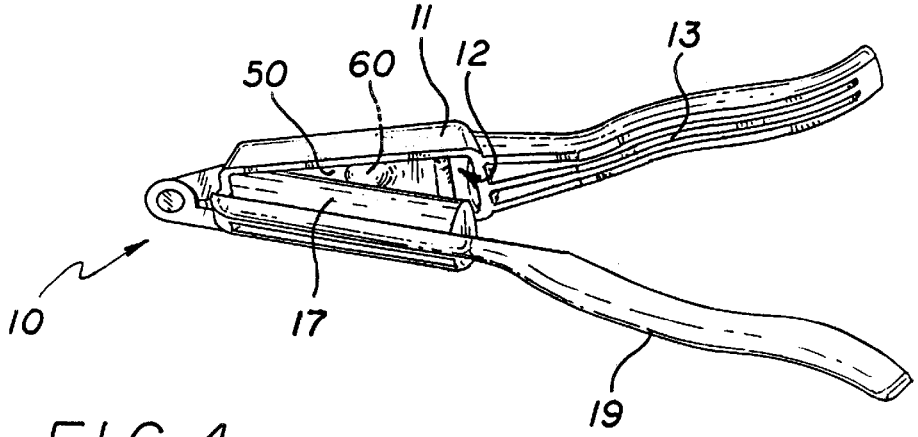
FIG. 4
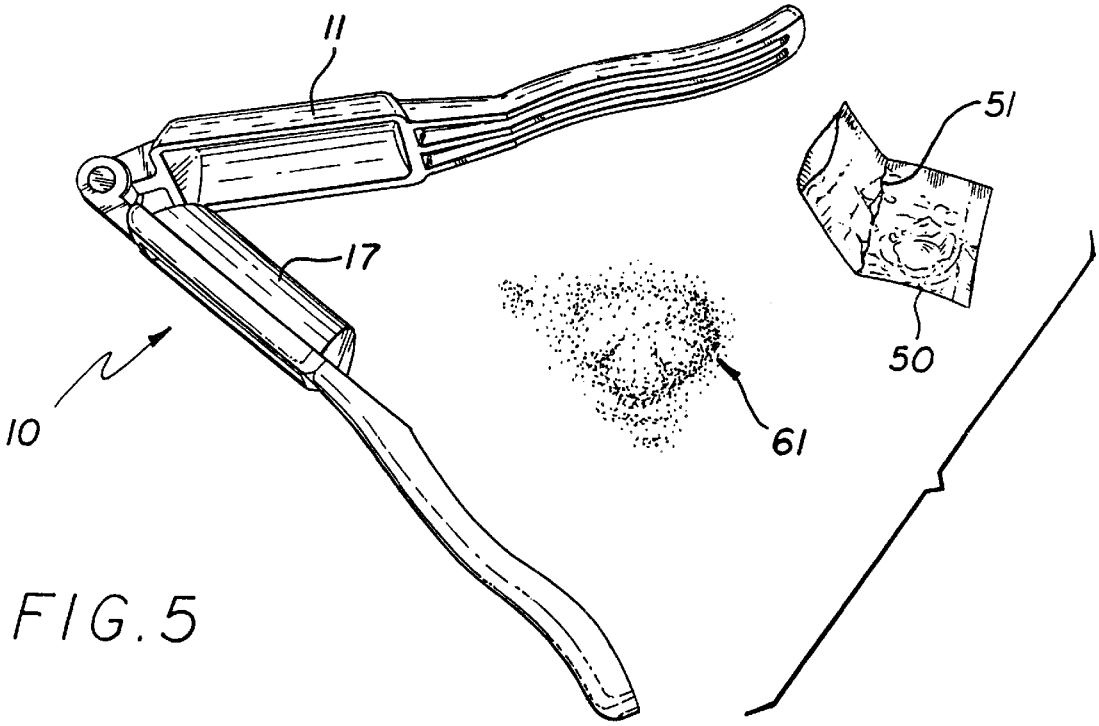
FIG. 5

CRUSHING METHOD AND APPARATUS

BACKGROUND OF THE INVENTION

I. Field of the Invention

This invention is in the general field of crushing methods and apparatus;

The invention is more particularly related to crushing of small items such as medicine pills and food items like garlic.

The invention is even more directly related to crushing of such small items and reducing them to small particulate bits with emphasis on the dispensing of such bits in an appropriate manner for the particular item involved.

II. Description of the Prior Art

There are various crushers for medicine pills. All of those with which I am familiar operate on the principle of a directly applied force, such as a hammering-like action, or other directly applied force perpendicular to the axis of the article being crushed. The present invention uses a unique force application at an acute angle to the axis of the article being crushed so that the article being crushed is gradually broken down over its length and/or width.

There are numerous presses for garlic and the like. All of the presses of which I am aware for such use consist of a pocket with perforations in the bottom and a pressing member which moves vertically within the pocket to squeeze garlic or the like through the perforations where it falls to a surface suitable to collect the garlic. Great pressure is required, and in the case of garlic or the like this can result in significant bruising or other damage to the product. Additionally, waste created by the operation collects within the pocket. It is quite difficult to remove the waste and clean the press.

A special embodiment of the crusher of this invention can be used to press garlic and the like. In this embodiment, garlic or the like is placed in a specially formed holding pocket. A perforated pocket collects garlic or the like which is forced into the perforated pocket by relatively light pressure applied on a bias. The garlic or the like is collected in the perforated pocket for easy removal when desired. Waste material, being outside of the perforated pocket and within the holding pocket, is easily removed and the crusher is easily cleaned.

In this regard I know of no prior art using a crushing method or apparatus of the nature of the within described and illustrated method and apparatus.

SUMMARY OF THE INVENTION

In the field of medicine there are many medicines which are supplied in the form of pills. A few common examples are aspirin, many vitamin supplements, antibiotics, and the like.

In the field of foods there are certain items which are crushed. Garlic is one of the most common food items to be crushed, although there are others which are commonly crushed.

In crushers for pills presently known to me there are three basic types. One is for home use and the other two are more designed for institutional use.

The home use type pill crushers consist of a threaded cylindrical chamber closed at one end and a threaded rod which is screwed into the chamber. A pill is placed within the chamber, and the threaded rod is turned to exert pressure against the pill to crush it. This type crusher requires considerable pressure and is not suitable for people with arthritis or other disabilities. Additionally this type crusher frequently requires repeated activation in order to properly crush a pill.

The two institutional type crushers are both based upon the principle of hammering the pill. With one type, a pill is placed in a first paper cup, the first cup is placed into a socket, a second paper cup is placed within the first paper cup on top of the pill, a hammer-like instrument then hammers the interior bottom of the second cup until the pill is crushed. This requires considerable force and is rather noisy. The second cup is then discarded and the crushed pill in the first cup is dispensed to a patient. Another disadvantage to this is that the crushed pill must generally be used immediately to avoid spillage or contamination, and it is difficult to identify the crushed pill.

Another institutional pill crusher known to me is an electric battery operated hammer mechanism which is used by placing a pill in a stiff paper envelope, placing the envelope within an opening wherein the electric battery operated hammer beats on the envelope until the pill is crushed. This is very noisy. Further, the battery must be replaced or recharged frequently.

Both of the institutional type crushers are expensive, noisy, and not readily portable.

I have studied this situation and have now conceived and developed a crusher and method which can be used for many purposes. It is especially effective for crushing pills and small food items.

I have accomplished this by providing a pocket pivotally connected to a boss having the same exterior configuration as the interior configuration of the socket. The pivotal connection is such that a pill placed within the socket receives a gradual squeezing type pressure and disintegrates easily, with no noise and no excessive pressure required. Additionally the device can be carried by a nurse or other person in a coat pocket. The device is economical and can be used for both institutional and home use. As a part of the system I have developed a special pouch in which the pill can be, but not necessarily must be, crushed. The use of the pouch is considered preferable as it prevents residue from adhering to the crusher and possibly contaminating another pill being crushed. Also, the pouch may be marked with information concerning the type pill, the patient's name, time administered, and the like. The pouch, after the crushed pill is taken may then be saved as record of medication taken.

It is an object of this invention to provide a crusher and method for crushing pills, food, and the like which is economical and easy to carry about;

Another object is to provide such a crusher which crushes on a bias with little pressure being required for crushing;

Another object is to provide such a crushing method wherein a pouch can be used to contain the article being crushed and to act as a record of the article and its use.

The foregoing and other objects and advantages will become apparent to those skilled in the art upon reading the description of a preferred embodiment, which follows, in conjunction with a review of the appended drawings.

BRIEF DESCRIPTION OF THE DRAWINGS

FIG. 3 is a perspective of the device of FIG. 1 fully opened and with a pill partially inserted in a pouch for crushing;

FIG. 4 is a perspective of the device of FIG. 1 with a pill in a pouch in place and about to be crushed;

FIG. 5 is a perspective of the device of FIG. 1 partially opened and showing a crushed pill removed from a pouch and the empty pouch;

DESCRIPTION OF A PREFERRED EMBODIMENT

Figure 1:
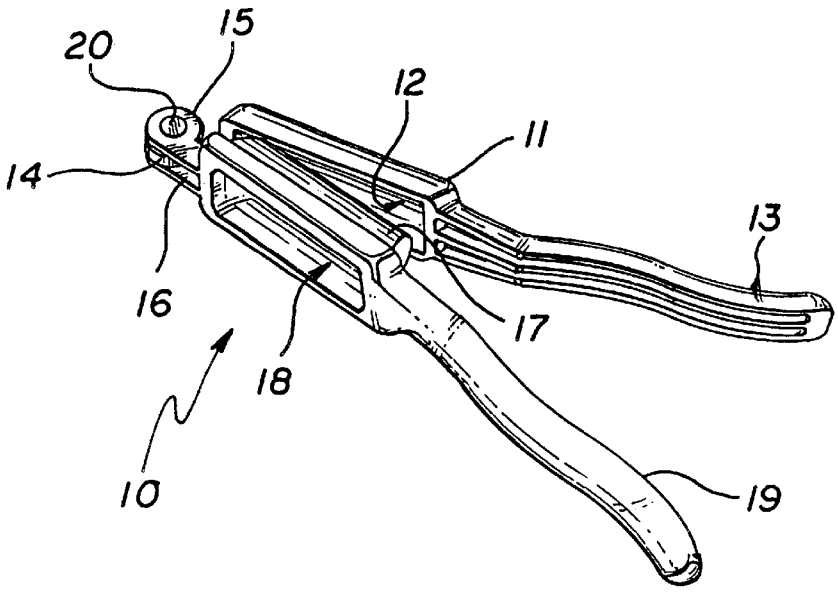
FIG. 1 is a perspective of a preferred apparatus to practice the method of this invention.

FIGS. 1 through 7 show a preferred apparatus (device) 10 for practicing the method of this invention. The apparatus comprises a semi-cylindrical member 11 with a semi-cylindrical interior pocket or cavity 12, handle 13, and pivot arm 14; and a semi-cylindrical boss member 17 with a semi-cylindrical pocket or cavity 18, handle 19, and pivot arms 15 and 16. Each of the pivot arms 14, 15, and 16 has a suitable hole through which a pivot pin 29 is inserted and joins the pivot arms 14, 15 and 16 in a pivoting relationship as shown. The ends 20 and 21 of the member 11 depend outwardly from the bottom of the pocket 12 at an angle as shown. Curved handle 13 depends outwardly from the end 21. Pivot arm 14 depends outwardly from the end 20.

The ends 22 and 23 of the member 17 depend outwardly from the bottom of member 17 at an angle as shown and of a size so that when fully closed, with pivot pin 29 passing through appropriate holes in arms 14, 15 and 16, the member 17 will fit, or mate, within pocket 12 with the ends 22 and 23 in contact with ends 20 and 21.

Figure 2:
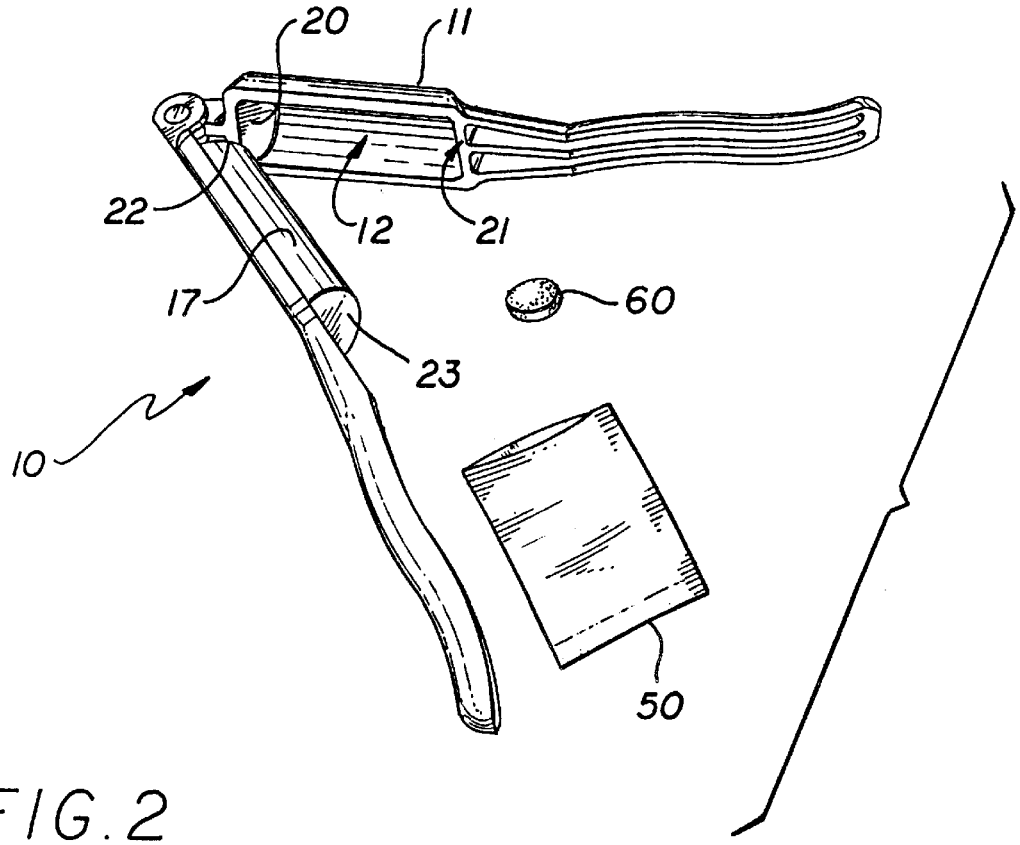
FIG. 2 is a perspective of the device of FIG. 1 partially opened and with a pill and a pouch to hold the pill while being crushed.
Figure 6:
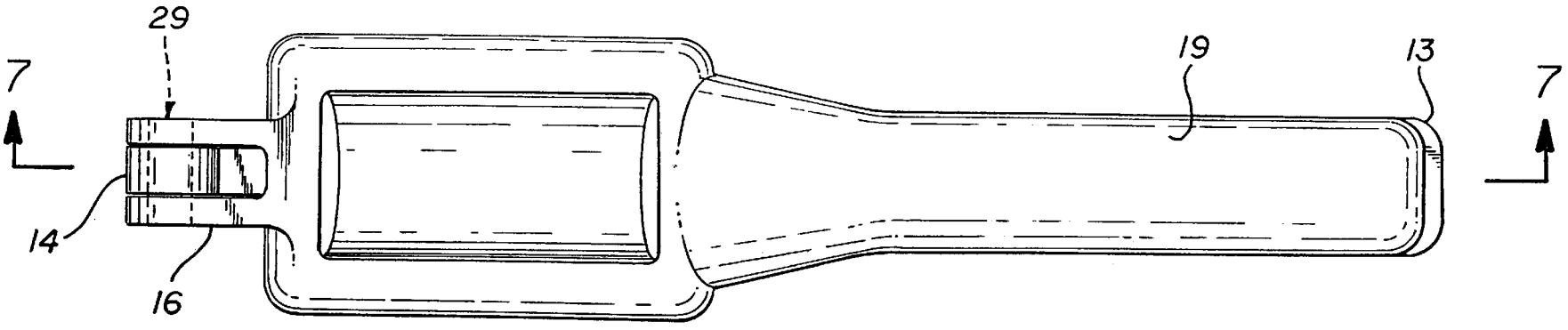
FIG. 6 is an enlarged top plan view of the device of FIG. 1 in a nearly closed condition while crushing a pill.

As indicated in FIG. 2 a medicinal pill or the like 60 and a paper or plastic pouch or the like 50 will be utilized for containing the pill while being crushed. The pouch 50 is closed on two sides and one end and open at one end. After the pill or the like has been inserted in the pouch, the pouch will be folded over along fold line 51. The pill or the like will be in the half of the pouch adjacent the closed end. By being folded over, the pouch will hold the pill in such manner that the crushed pill does not spill out of the pouch. Other means of closing the pouch could be used, but this is the simplest and most desirable. While the exact material used for the pouch is not critical for effective crushing, it has been found that clear plastic (for example, polyethylene of approximately 1.5 mil thickness) is very desirable. The crushed pill can be viewed through the clear plastic. If it is less than fully crushed it can be subjected to further application of pressure. Some large pills may require this extra crushing.

Figure 7:
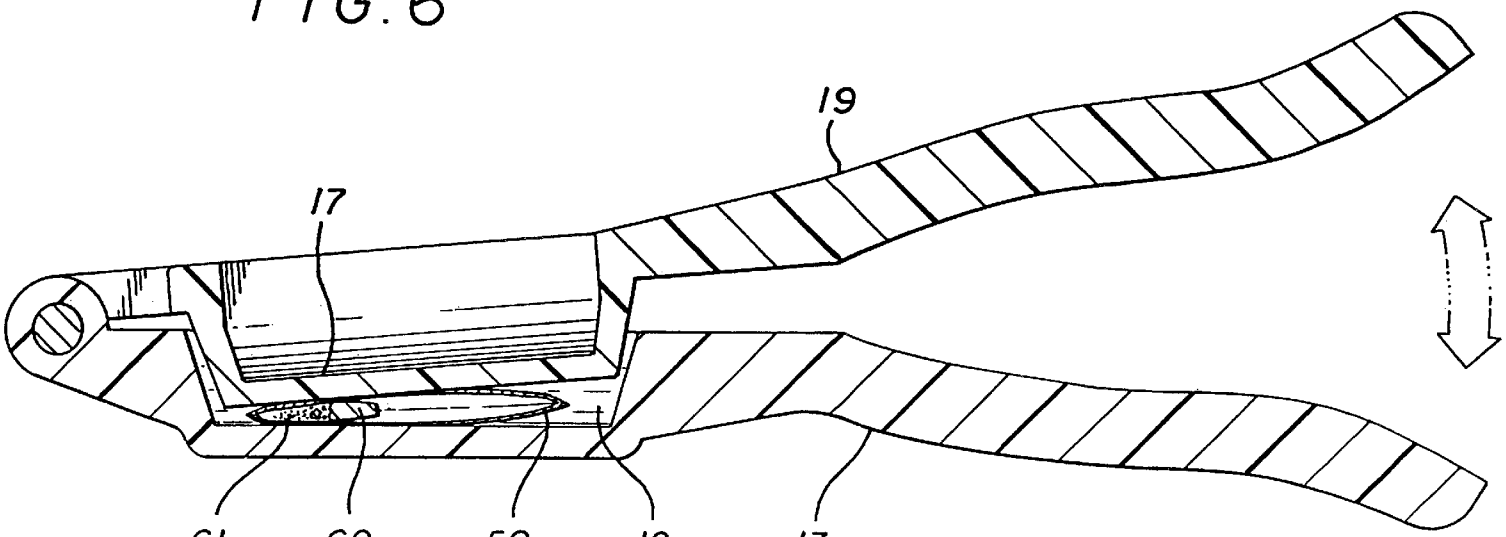
FIG. 7 is a section on 7—7 of FIG. 6 showing a partially crushed pill.

FIG. 3 shows the pill 60 being inserted into the pouch 50. After the pill 60 has been fully inserted in the pouch 50, the pouch is folded in half along crease line 51 with the open end adjacent the closed end. The folded pouch with the pill inside is placed into the pocket 12 as shown in FIG. 4. The handles 13 and 19 are squeezed together and the pill gradually crumbles easily due to the gradual application of force by the transmission of bias pressure of member 17 over the length or breadth of the pill as shown in FIG. 7. It will be noted that the rounded member 17 is pressing at a gradually decreasing angular relationship to horizontal. This results in minimal pressure being required as compared to the condition which would result if the member 17 was pressing in a vertical direction as is the situation with prior art devices.

As shown in FIG. 7, the pill 60 in the envelope 50 has partially broken as indicated at 61. Further pressure will pulverize the entire pill to the condition shown in FIG. 5.

Figure 8:
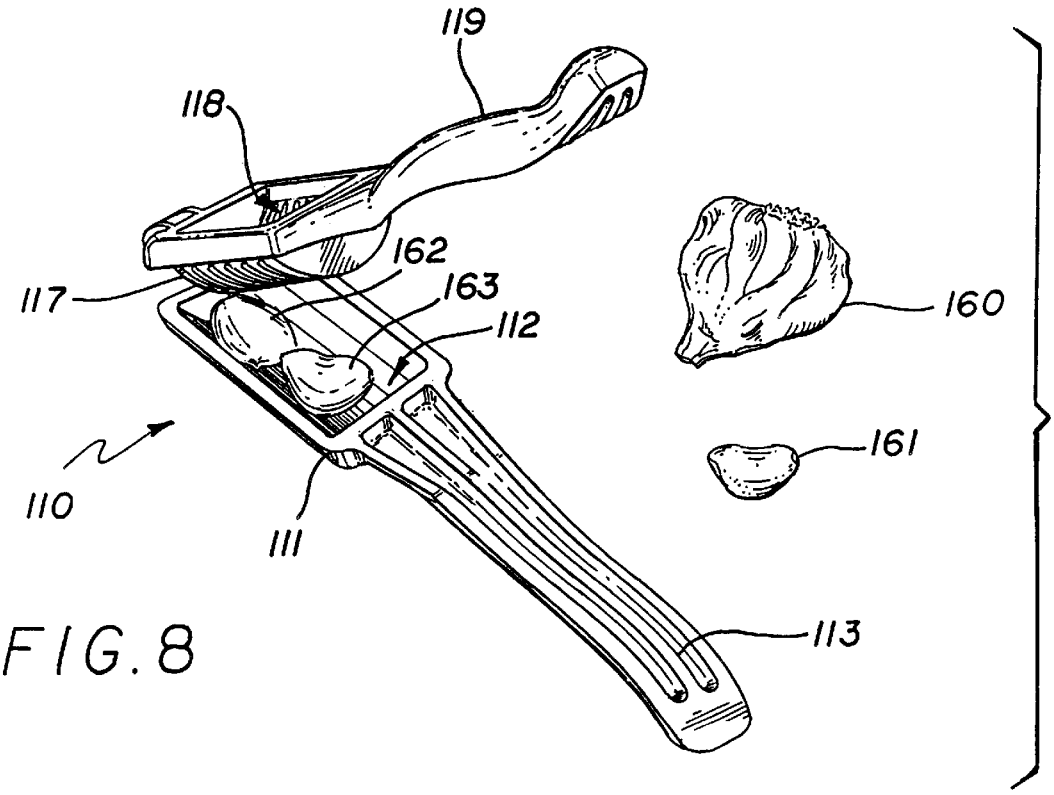
FIG. 8 is a perspective of a modified version of the device of FIG. 1 with garlic about to be crushed.
Figure 9:
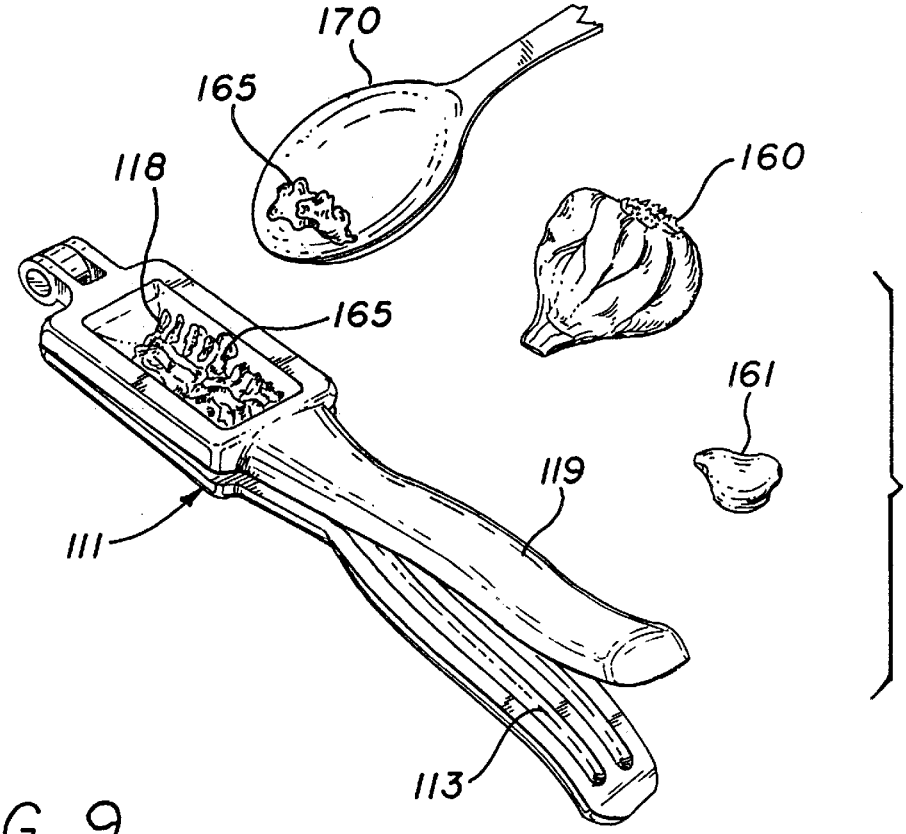
FIG. 9 is a perspective of the device of FIG. 8 showing the results of crushing garlic therein.

A modified version of the crushing method and the crusher of this invention particularly adapted to crush garlic and the like is shown in FIGS. 8 and 9. This version of the crusher is identical to the pill crusher previously described except that the boss member 117 (similar to member 17 of the pill crusher described above and shown in FIGS. 1 through 7) has a number of apertures 130 and has been given reference numeral 117 as shown in FIGS. 8 and 9. The member 117 has pivot arms 115 and 116 and the member 111 has pivot arm 114 which are connected in a pivoting relationship by pivot pin 120 through appropriate holes in the pivot arms as will be known to those skilled in the art. The apertures 130 are preferably in the form of semi-circumferential slots as shown in FIGS. 8 and 9. However if desired, a screen like pattern, a number of round holes, or the like could be used.

The other items of the version shown in FIGS. 8 and 9 are identical to the similar items of the version shown in FIGS. 1 through 7 and have been given similar reference numerals but in the 100 series).

A head of garlic 160 is shown in FIG. 8, with cloves 161, 162, and 163 removed from the head. Cloves 162 and 163 have been placed in the pocket 112 of member 111. The handles 113 and 119 are then squeezed together. This forces bits of garlic 165 through the apertures 130 and into pocket 118 inside member 117. The bits of garlic 165 can be conveniently removed from pocket 118 by a spoon 170 or the like. An advantage of slots as shown in FIGS. 8 and 9 as compared to the holes used in most garlic presses is that the garlic or the like may be forced into the inside pocket 118 of member 117 in the form of very fine slice like items 165 preserving the integrity of the garlic with minimal bruising and destruction of the desired characteristics of the material.

While the embodiments of this invention shown and described are fully capable of achieving the objects and advantages desired, such embodiments are for purposes of illustration only and not for purposes of limitation.

I claim:

1. A method of crushing medicinal pills comprising: placing a pill to be crushed in a pouch closed on two sides and one end and open at one end in such manner that the pill is adjacent the closed end of the pouch; folding the pouch in such manner that the open end is adjacent the closed end; placing the pill in the folded pouch in a semi-cylindrical cavity in a first mechanical member pivotally connected to a second mechanical member having an exterior semi-cylindrical configuration suitable to mate with the interior of the semi-cylindrical cavity in which the pill has been placed; and pivotally activating the exterior semi-cylindrical configuration of the second mechanical member into the cavity in the first mechanical member in such manner that a biased force acts upon the pill crushing the pill gradiently.

2. A method of crushing material comprising: placing material to be crushed in a semi-cylindrical cavity in a first mechanical member pivotally connected to a second mechanical member having an exterior semi-cylindrical configured boss suitable to engage with the interior of the cavity in which the material to be crushed has been placed;

and pivotally activating the second mechanical member into the cavity in the first mechanical member in such manner that a biased force acts upon the material between the interior of the cavity and the exterior of the semi-cylindrical configured boss crushing the material gradiently.

3. A method of preparing garlic for use comprising: placing garlic to be prepared in a first pocket in a first mechanical member pivotally connected to a second mechanical member having an exterior configuration suitable to generally conform to the interior of the first pocket in which the garlic has been placed and having a second pocket formed therein with the pocket having walls with a thickness and with a multiplicity of apertures through the walls communicating between the interior of the second pocket and the exterior configuration of the second pocket; and pivotally activating the second mechanical member into the first pocket in the first mechanical member in such manner that a biased force acts upon the material crushing the garlic gradiently and forcing the crushed garlic through the apertures and into the second pocket.

4. The method of claim 3 wherein the biased force acts upon the material crushing the garlic gradiently and forcing the crushed garlic through semi-circumferentially aligned slots in the second mechanical member and into the second pocket.

5. Apparatus for crushing material comprising: a first mechanical member having a first semi-cylindrical cavity suitable to contain material to be crushed; a second mechanical member having a second semi-cylindrical cavity and an exterior semi-cylindrical configuration suitable to mate with the interior of the first semi-cylindrical cavity pivotally connected to said first mechanical member; and means for pivotally activating the second mechanical member into the cavity in the first mechanical member in such manner that a biased relationship may be activated between the interior of the cavity in the first mechanical member and the exterior configuration of the second mechanical member terminating in a nearly complete nesting of the exterior semi-cylindrical configuration of the second mechanical member within the interior of the first semi-cylindrical cavity of the first mechanical member.

6. Apparatus for crushing material comprising: a first elongate member having a first exterior semi-cylindrical surface, a second interior semi-cylindrical surface, a first end and a second end, each end having an interior surface and an exterior surface with each surface depending at an angle such that a first semi-cylindrical open cavity element having an open top, a closed bottom, a first exterior shape, and a second interior shape is formed with angular ends in such manner that the first semi-cylindrical open cavity element is longer at the open top than at the closed bottom; a first handle affixed integrally to the exterior of the first end; a first hinge boss affixed integrally to the second end; a second semi-cylindrical open cavity element formed in the same manner as the first semi-cylindrical open cavity and having a first end and a second end, said second semi-cylindrical open cavity element having a third exterior shape of shape and dimensions such that a third exterior shape of said second semi-cylindrical open cavity element nests within and conforms to the second interior shape of said first semi-cylindrical open cavity element; a second handle affixed integrally to the exterior of the first end of said second semi-cylindrical cavity element; a second hinge boss affixed integrally to the second end of said second semi-cylindrical open cavity element; and hinge means connecting said first hinge boss and said second hinge boss.

* * * * *